US006028273A

United States Patent [19]

Osborn, Jr.

[11] Patent Number: 6,028,273

[45] Date of Patent: Feb. 22, 2000

[54] ANTI-VIBRATION RETAINING CLIP FOR AN ELECTRICAL SWITCH WITH CONNECTOR INTERLOCK

[75] Inventor: Robert H. Osborn, Jr., Collierville, Tenn.

[73] Assignee: Thomas & Betts International, Inc., Sparks, Nev.

[21] Appl. No.: 09/187,310

[22] Filed: Nov. 4, 1998

[51] Int. Cl.[7] ..... H01H 9/28

[52] U.S. Cl. ..... 200/51.09; 200/43.14; 200/43.19

[58] Field of Search ..... 200/43.01, 43.11, 200/43.13–43.19, 43.21, 50.01, 50.02, 318, 318.1, 321, 322, 327, 50.11, 333, 334

[56] References Cited

U.S. PATENT DOCUMENTS

| | | | |
|---|---|---|---|
| 1,772,982 | 8/1930 | Brachtl | 200/17 R |
| 2,752,441 | 6/1956 | Frank | 200/44 |
| 3,117,208 | 1/1964 | Svensson | 200/169 |
| 3,186,981 | 6/1965 | De Ronde | 200/169 |
| 4,057,794 | 11/1977 | Grossfield | 340/311 |
| 5,039,829 | 8/1991 | Brucksch | 200/43.18 |
| 5,207,315 | 5/1993 | Benda | 200/43.11 |
| 5,412,167 | 5/1995 | Mueller et al. | 200/43.14 |

*Primary Examiner*—Michael Friedhofer
*Attorney, Agent, or Firm*—Brian S. Welborn

[57] ABSTRACT

An electrical switch with connector interlock apparatus having a reusable clip-on anti-vibration retaining clip assembly used to retain the spring biased operating member in the "on" position for high vibration application. In heavy high vibration environments, the clip assembly prevents the pushrod/operating member from vibrating out and tripping the circuit breaker. The clip assembly includes a clip preferably formed from 16 gauge pre-galvanized steel. One end of the clip is generally U-shaped to Fit into a groove formed in a bushing mounted in the wall. The opposite end of the clip extends over and engages the knob of the operating member thereby acting as the stop for the pushrod knob. With a plug inserted into the module, the pushrod must be pushed in to a second position in order to actuate the circuit breaker thereby compressing a pushrod spring. This results in stored energy in the spring. When vibration is introduced with an amplitude in the axial direction of the pushrod, the pushrod may work it way out with assistance from the compressed spring. The clip assembly prevents the pushrod from vibrating out under these conditions.

2 Claims, 14 Drawing Sheets

ANTI-VIBRATION RETAINING CLIP FOR AN ELECTRICAL SWITCH WITH CONNECTOR INTERLOCK

FIELD OF THE INVENTION

The present invention relates generally to mechanical interlocking mechanisms for preventing electrical power receptacles or inlets from remaining electrically live when they are connected to or disconnected from electrical plugs or connectors and also to prevent such receptacles or inlets from being electrically live at any time that an electrical plug or connector is not present within that receptacle or inlet. In even greater particularity, the present invention relates to an anti-vibration retaining clip for a mechanical interlocking mechanism which prevents premature tripping of a circuit breaker within an electrical power receptacle during use.

BACKGROUND OF THE INVENTION

Various types of electrical outlet receptacles have been provided for use in marine, commercial and industrial applications with an included interlocking mechanism to reduce the hazards of inserting into or withdrawing a plug from such a receptacle while the receptacle is in a live condition. A common application of this type of outlet receptacle involves refrigerated containers that are transported on land by trucks and on sea by ships. When these containers are transported on land, electrical power to drive the refrigeration system is provided by the transporter, such as the tractor pulling the container. When these containers are delivered for loading onto ships, however, the electrical plugs for powering the refrigeration unit must be plugged into a shore-side power source, and when on board a ship, they must be plugged into a source of electrical power on the ship. When the refrigerated container is at dockside or on board the ship, the source of electrical power should be sealed water-tight to protect against the wet environment and potential problems of corrosion and rust from salt water and salt air. Additionally, because the current is typically 220 volts or 440 volts with substantial amperage, it is important that the receptacle be provided with apparatus that prevents inserting or withdrawing a plug while the circuit is live, and which apparatus also switches off power to the receptacle when a plug is not present. While various means, most commonly involving o-ring seals, have been widely used to effect waterproof sealing of such units, problems have remained with respect to the interlocking mechanisms.

For example, in one such type of interlocking mechanism, a spring loaded operating member or pushrod is used to reset or turn on the circuit breaker. To operate the mechanism, a user pushes the spring loaded operating member inwardly of the interlock housing which in conjunction with an actuating member engages and moves a circuit breaker switch handle to a circuit completing position. The spring used to spring load the operating/actuating members is compressed upon inward movement of the operating member, thus provides resistance in the outward direction against the circuit breaker switch handle. Ideally, the size of the spring is selected to bc sufficiently weak not to trip the circuit breaker switch handle after it has been set. While it is known to use some type of pre-assembled clip internally of the interlock mechanism (luring transportation, which must be removed before use of the interlock mechanism, it has been discovered that interlock mechanisms employing such spring loaded operating members experience premature tripping of the circuit breaker during use in heavy vibration environments. When vibration is introduced with an amplitude in the axial direction of the actuating member, the actuating member may work its way out with assistance from the compressed spring thereby tripping the breaker. Therefore, a need exists for a device that will not allow premature tripping of a circuit breaker in heavy vibration environments.

SUMMARY

The present invention addresses the above needs by providing an electrical switch with connector interlock apparatus having a reusable clip-on externally applied anti-vibration retaining clip assembly used to retain the spring biased module pushrod or operating member in the "on" position for high vibration application, the pushrod being supported for sliding movement by bushings, one of which is mounted in the wall of the module housing and extends outwardly therefrom a suitable distance. In transit applications, where vibration is a constant occurrence, such as railroad or truck transit, the clip assembly of the present invention prevents the pushrod/operating member from vibrating out and tripping the circuit breaker. The clip assembly includes a clip preferably formed from 16 gauge pre-galvanized steel. One end of the clip is generally U-shaped to fit into a groove formed in the pushrod bushing mounted in the wall. The opposite end of the clip extends over and engages the knob of the pushrod thereby acting as the stop for the pushrod knob. With a plug inserted into the module, the pushrod must be pushed in to a second position in order to actuate the circuit breaker thereby compressing a pushrod spring. This results in stored energy in the spring. When vibration is introduced with an amplitude in the axial direction of the pushrod, the pushrod may work it way out with assistance from the compressed spring. The clip assembly of the present invention prevents the pushrod from vibrating out under these conditions. If desired, the clip assembly may be permanently attached to the receptacle of the module by way of a cable assembly, to allow reusability without risk of losing the clip, using a clip cable assembly that is attached to the receptacle mounting screw which acts as the ground screw. It should be understood that the clip does not prevent the circuit breaker from tripping should an over-current condition exist due to the design of the interlock mechanism. Simply by removing the clip manually, one can determine if a trip condition exists by observing the pushrod position.

A preferred embodiment of the present invention includes an electrical switch and interlock apparatus comprising a housing; a switch unit mounted within the housing and adapted to be connected to a source of electrical power for selectively completing or breaking an electrical circuit; a switch unit operating member being mounted to the housing for sliding movement between a first position and a second position, the operating member supported by a first bushing through the housing and a second bushing through an internal support tray and including a handle for enabling a human operator to move the operating member between the first and second positions; an actuating member mounted for movement corresponding to the movement of the operating member between the first and second positions and being operatively connected to the switch unit for moving a portion of the switch unit between a first, open circuit state when the actuating member is in the first position and a second, circuit completing state when the actuating member is in the second position, noting that the actuating member is resiliently biased toward the first position; and an anti-vibration retaining clip assembly for maintaining the operating member in the second position, the retaining clip assembly having a clip with one end releasably attached to the first bushing and an opposite end engaging the handle so as to prevent the operating member from moving to the first position. The anti-vibration retaining clip assembly may further include a cable assembly for permanently attaching the clip to the housing.

BRIEF DESCRIPTION OF THE DRAWINGS

These and other features, aspects, and advantages of the present invention will become better understood with regard to the following detailed description and accompanying drawings where.

DETAILED DESCRIPTION

Figure 1:
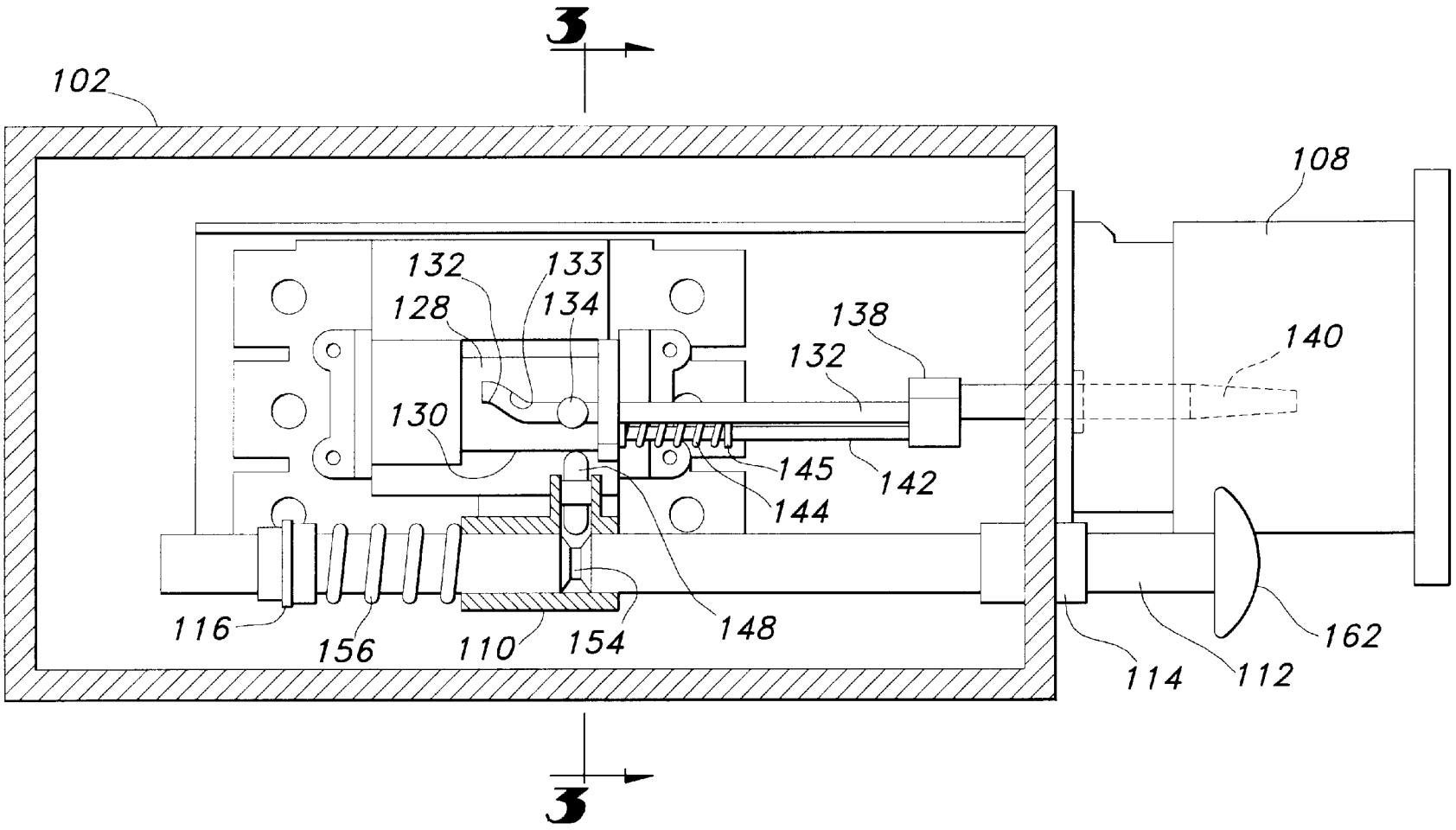
FIG. 1 is a top plan view, partially in section, of an electrical switch and interlock apparatus of the present invention, representing the apparatus when no plug is present in the receptacle and the circuit breaker is in the "off" position.

Referring now to the drawings for a better understanding of the present invention, a representative electrical switch with connector interlock apparatus 100 is generally illustrated throughout the figures with a portion of the housing cover removed for clarity. The apparatus includes a housing 102, which may be conveniently fabricated of suitable metal and to which are mounted one or more circuit breakers 104, each having a switch handle 106, shown in the side view of FIG. 2, which may be moved between a first position illustrated in FIG. 2, in which the circuit within in the breaker is open, and a second position, illustrated in FIG. 9, in which the switch handle 106 is moved to a second circuit completing position. The circuit breaker includes an input power cable, not shown, connected through the circuit breaker to an output cable, not shown, which is connected to the plug receptacle 108. In the illustration of FIGS. 1–5, there is no plug inserted into the receptacle 108.

Mounted within the housing 102 is the circuit breaker actuating member 110, which may conveniently be machined of a suitable low friction synthetic resin, such as nylon or polyethylene. This actuating member 110 is mounted for sliding movement on operative member 112, which may suitably comprise a circular rod or tubular member supported by a bushing 114 through the housing 102 and another bushing 116 that is mounted to the support tray 118.

Figure 2:
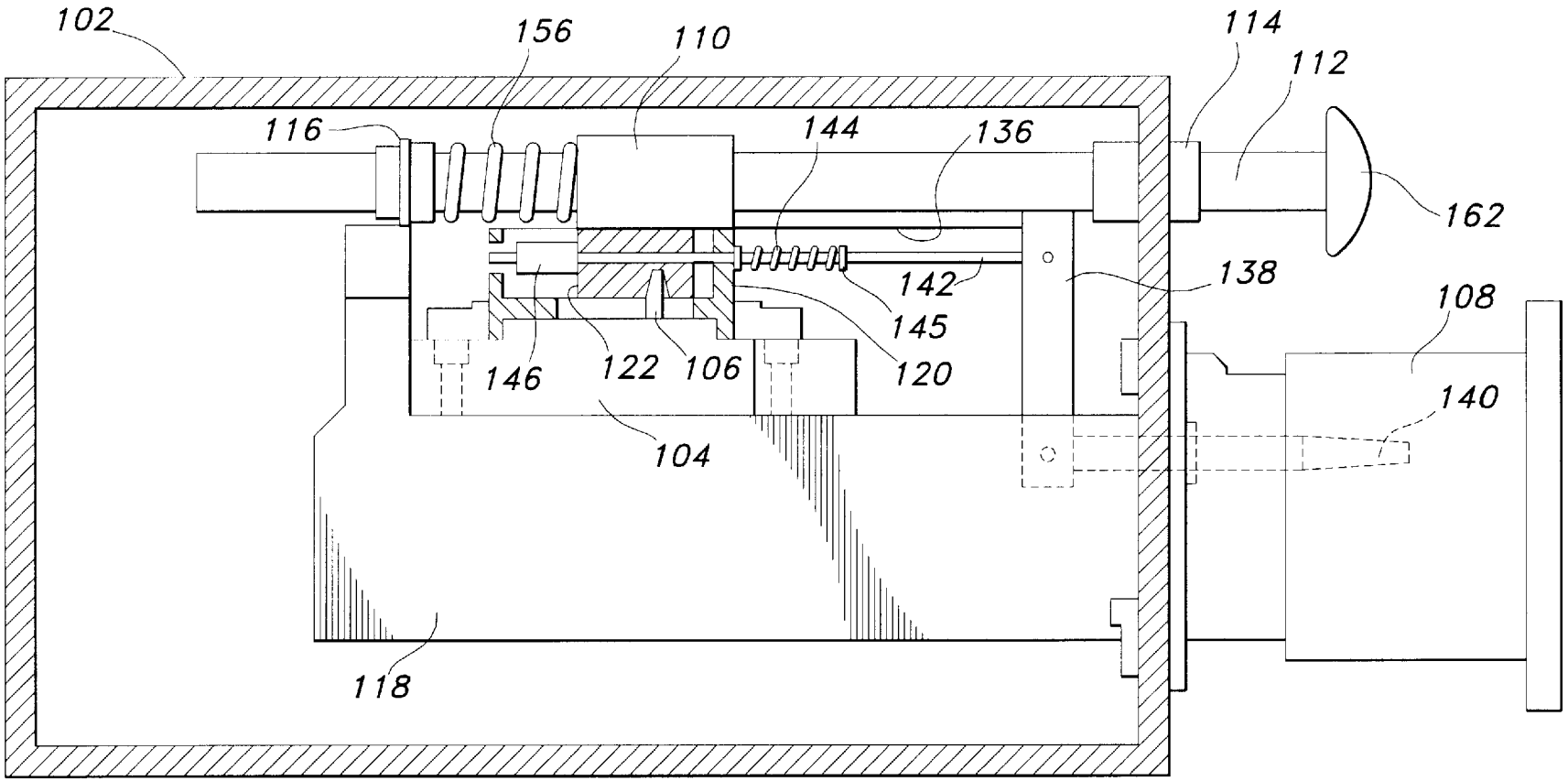
FIG. 2 is a side elevation, partially in section, of the apparatus of FIG. 1.
Figure 3:
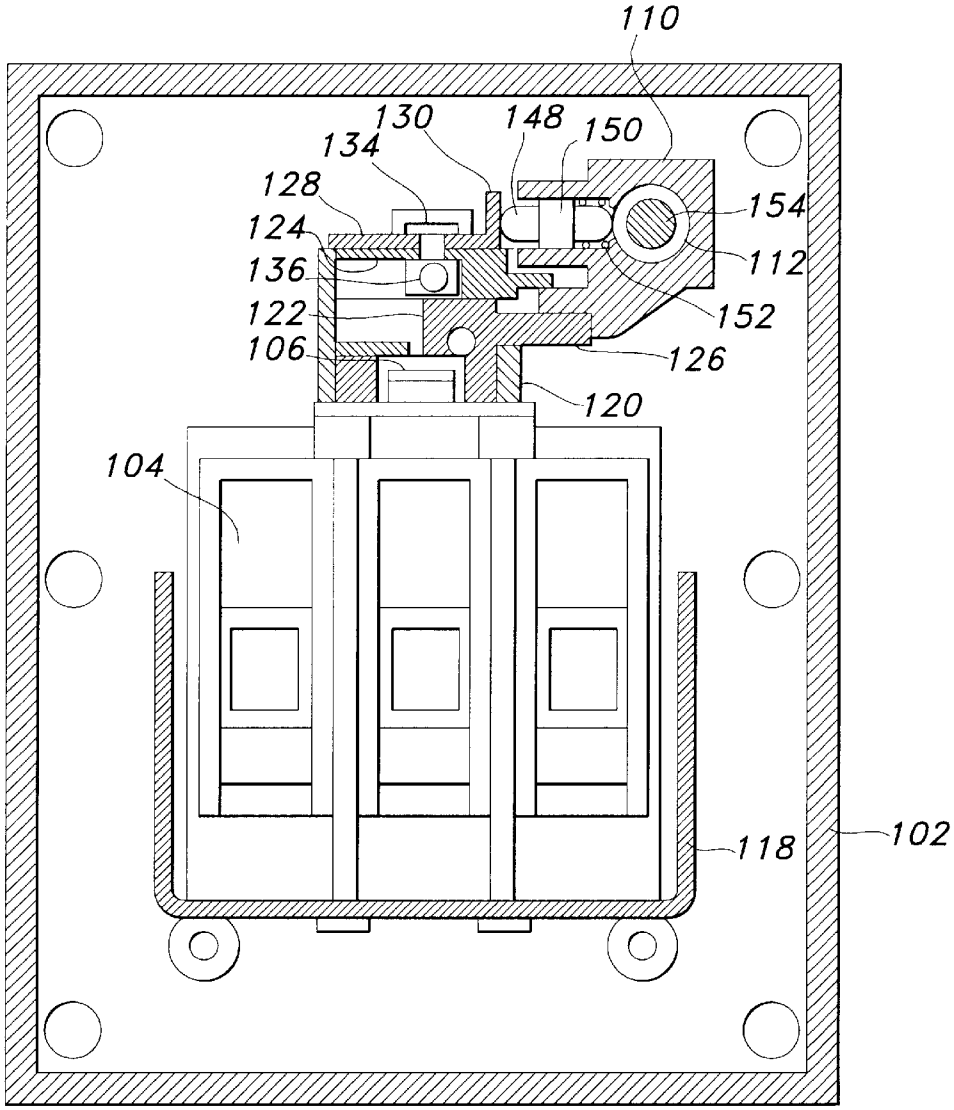
FIG. 3 is a sectional view taken along lines 3—3 of FIG. 1.

Mounted to the top of the circuit breaker is a toggle enclosure 120, suitably also fabricated of a synthetic resin, such as nylon or polyethylene. Mounted within that toggle enclosure 120 is a toggle retainer 122 that is capable of sliding longitudinally within the toggle enclosure between the positions illustrated in FIGS. 2, 5 and 7, to the right of those illustrations, and a second position, illustrated in FIG. 9, displaced to the left in that figure, or to the rear of the switch and interlock mechanism. This toggle retainer includes a slot that fits over the circuit breaker switch handle 106 to move that handle 106 as the toggle retainer 122 is moved. Fitting with the top of the toggle enclosure is a cover 124 that holds the toggle retainer 122 in place. As is indicated in FIG. 3, a portion 126 of the toggle retainer 122 extends outwardly and mates with a portion of the actuating member 110 in any suitable manner, such as by a tongue-and-groove arrangement of by pinning or by other conventional connections. Thus, the toggle retainer 122 will move in concert with the actuating member 110 and serves to operatively connect that actuating member 110 to the switch handle 106 of the circuit breaker 104.

Supported on top of the toggle enclosure cover for movement in a direction transverse to the longitudinal axis of the operating member 112 is a slide plate 128, which may conveniently be fabricated of either a rigid synthetic resin or metal, such as stainless steel. The slide plate 128 includes a connecting member actuating portion 130 and a pair of camming surfaces 132 and 133 in the form of the opposite sides of a generally S-shaped slot within which rides a cam follower 134 in the form of a headed pin, which is affixed to extension rod 136. This extension rod 136 is affixed to the upper end of a riser bar 138, as shown in FIG. 2, to the lower end of which is attached a plug engaging rod 140. Also affixed to the riser bar 138 close to extension rod 136 is second extension rod 142 carrying a resilient biasing element, such as compression spring 144 and its retainer 145. The combination of the plug engaging element 140, riser bar 138 and extension rods 136 and 142 comprise, together, an assembly referred to as a plug engaging member reciprocally mounted to the plug receptacle 108 for reciprocal movement upon the insertion and removal of a plug into and from that receptacle 108. Adjacent the end of extension rod 142 opposite the end connected to riser 138 is a retainer member 146, which, in the configuration shown in FIGS. 1 and 2, engages the back end of the toggle retainer 122. This retainer 146, in conjunction with compression spring 144 connected to the extension rod 142 and bearing against the front end of the toggle enclosure 120, urges the toggle retainer 122 and the circuit breaker switch handle 106 to the forward, open circuit position illustrated in FIG. 2.

As shown most clearly in FIG. 3, the actuating member 110 has connected to it a connecting member 148 which may be slidably received through a sleeve 150 and resiliently biased by suitable means, such as a spring 152, toward a retracted position bearing against the shoulder 130 of slide plate 128 and out of engagement with operating member 112, as shown in FIGS. 1 and 3. As may be seen in FIG. 1, the operating member 112 is provided with a recess, suitably in the form of a circumferential groove 154, for purposes to be described below. As shown in FIGS. 1 and 2, wherein there is no plug inserted into the receptacle 108, the operating member 112 is free to move longitudinally of its axis, to the left and right in FIGS. 1 and 2, sliding within the actuating member 110 and effecting no movement thereof. In this configuration, with no resistance provided by the actuating member 110 or the circuit breakers 104, biasing means, such as a compression spring 156, will urge actuating member 110 to the position shown in FIGS. 1 and 2.

Figure 4:
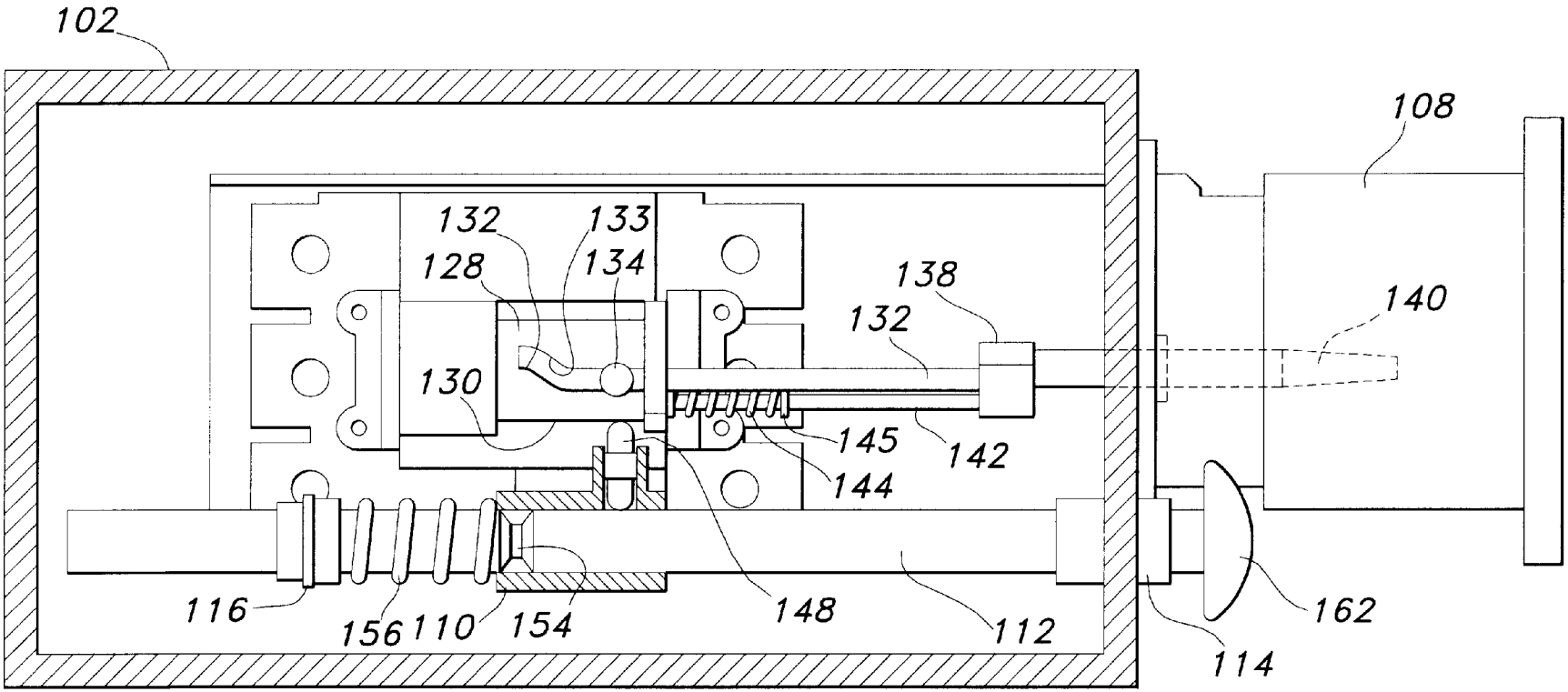
FIGS. 4 and 5 are, respectively, a top plan view and a side elevation of the apparatus of FIG. 1 with no plug present in the receptacle and an attempted reset of the circuit breaker with the circuit breaker remaining in the "off" position.
Figure 5:
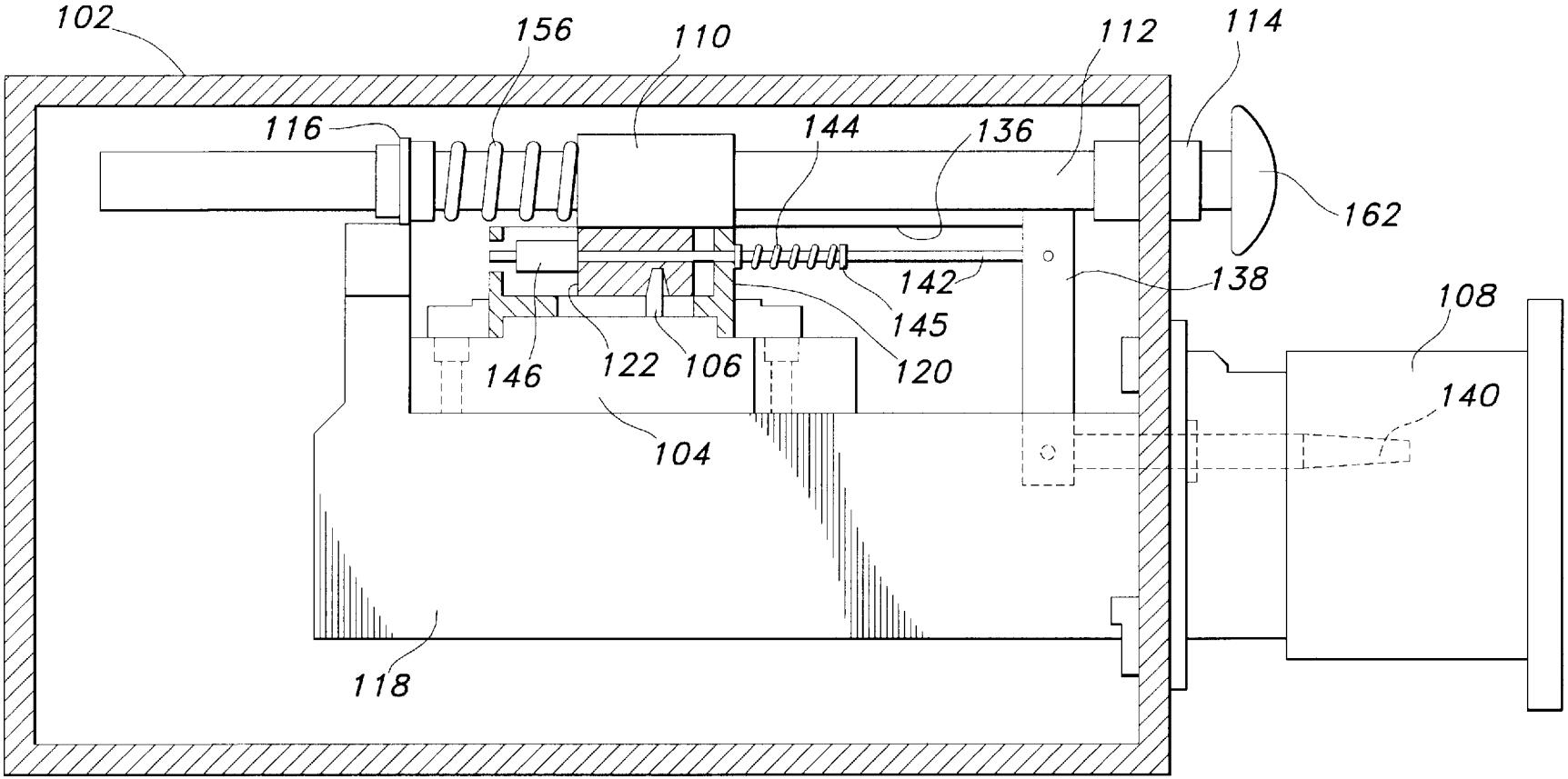

As shown in FIGS. 4 and 5, when there is no plug inserted into the receptacle 108, so that the plug engaging element 140 and the other elements 136, 138 and 142 remain urged to the right in these illustrations by the biasing means 144, there is no operative connection between the operating member 112 and the actuating member 110 to effect any joint or corresponding movement of the two, so that operating member 112 may simply slide in a reciprocating manner freely within the bore of actuating member 110. Thus, if a user attempts to reset the circuit breaker, to move the switch handle 106 from the first, open circuit position to a second, circuit completing position, there will be no connecting engagement between the operating member 112 and the actuating member 110 and its associated toggle retainer 122 to move the switch handle 106. Accordingly, all that will occur is movement of the actuating member 112, with the circuit breaker remaining in the open circuit position as shown in FIG. 5.

Figure 6:
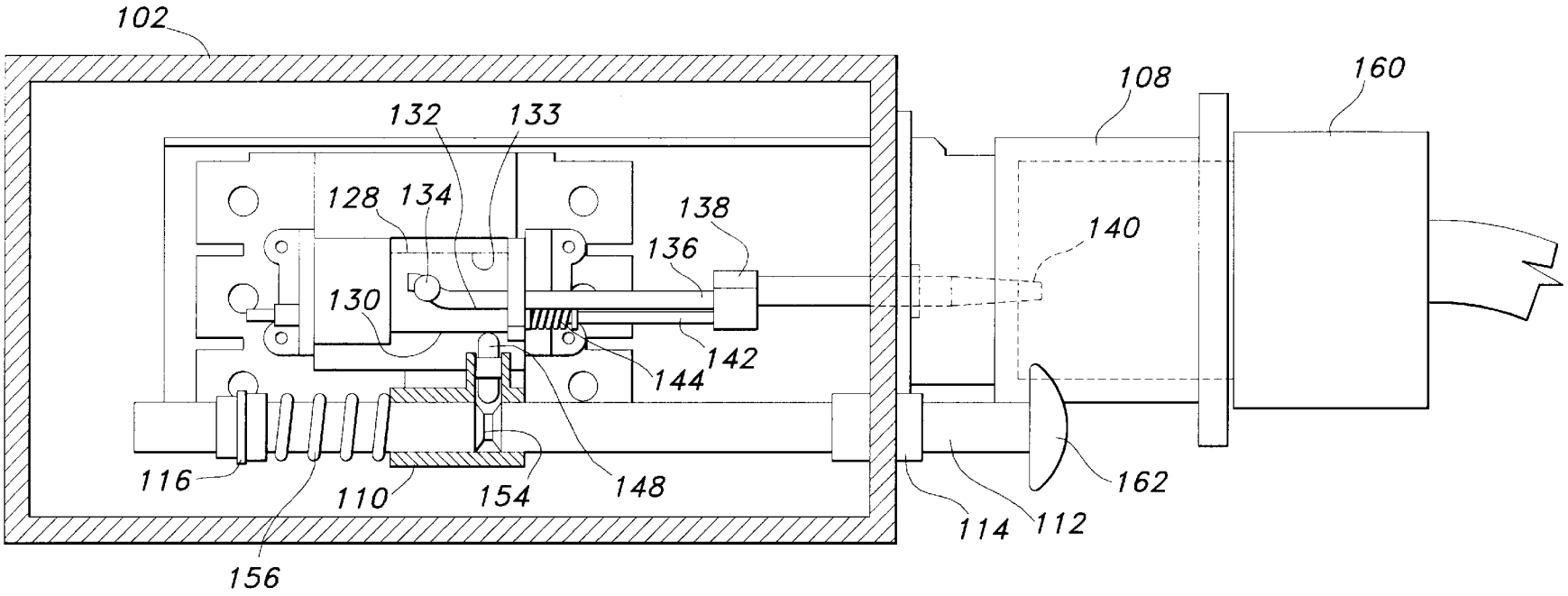
FIGS. 6 and 7 are, respectively, a top plan view and a side elevation of the apparatus of FIG. 1 with a plug inserted and the circuit breaker in the normal "off" position.
Figure 7:
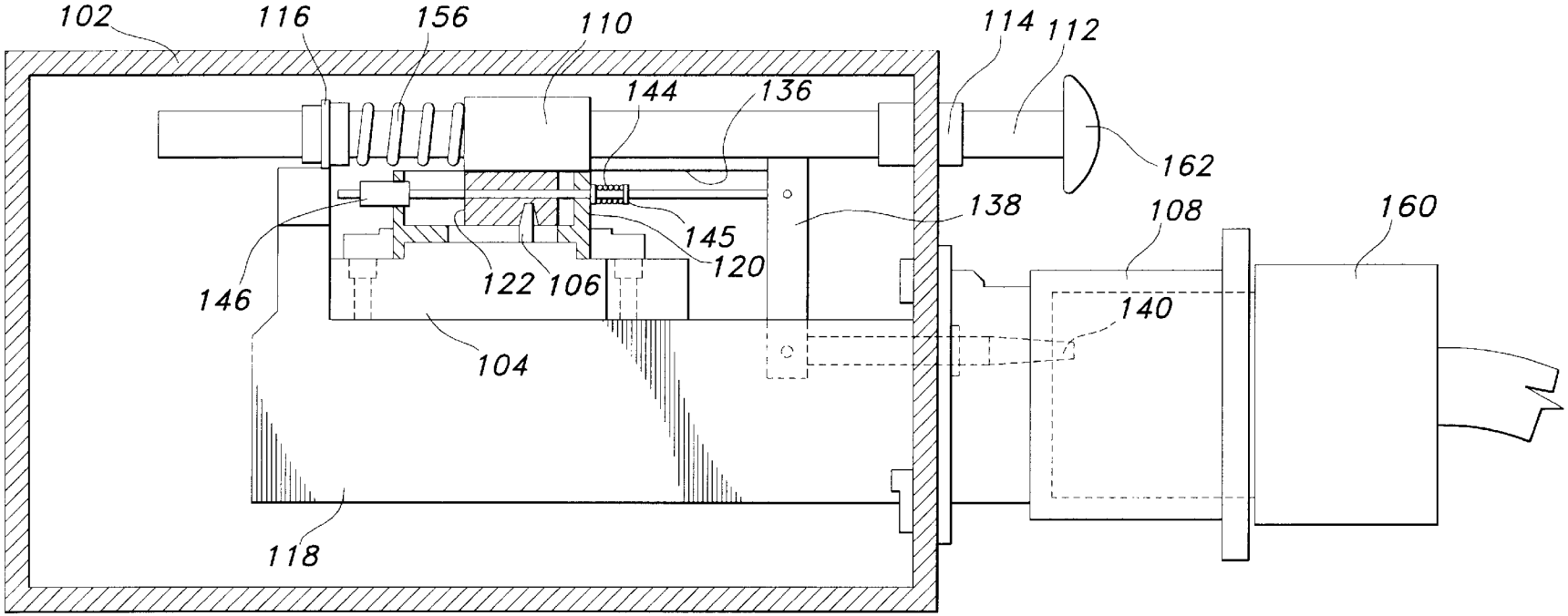

When a plug 160, such as a Mipco plug connecting a refrigerating system power cable to the power supply controlled by the apparatus of this invention, or any other conventional plug is inserted into the plug receptacle 108, it engages the plug engaging member 140 and moves it to the left, as shown in FIGS. 6 and 7. This urges the remainder of the components of the plug engaging member assembly likewise to the left in these illustrations and moves the pin 134, which serves as a cam follower, along the camming surface 132, thus driving the slide plate 128 in the direction toward the actuating member 110. The movement of the actuating portion 130 of the slide plate 128 in this direction thus drives the connecting member 148 in the same direction, urging it into the connecting engagement with the recess 154 of the operating member 112. In this configuration the actuating member 110 and the operating member 112 are connected together for corresponding, joint, movement, which in this embodiment will thus be coaxial movement of the two members along the longitudinal axis of the operating member 112. In the configuration illustrated in FIGS. 6 and 7 the circuit breaker remains off but is now ready to be reset.

Figure 8:
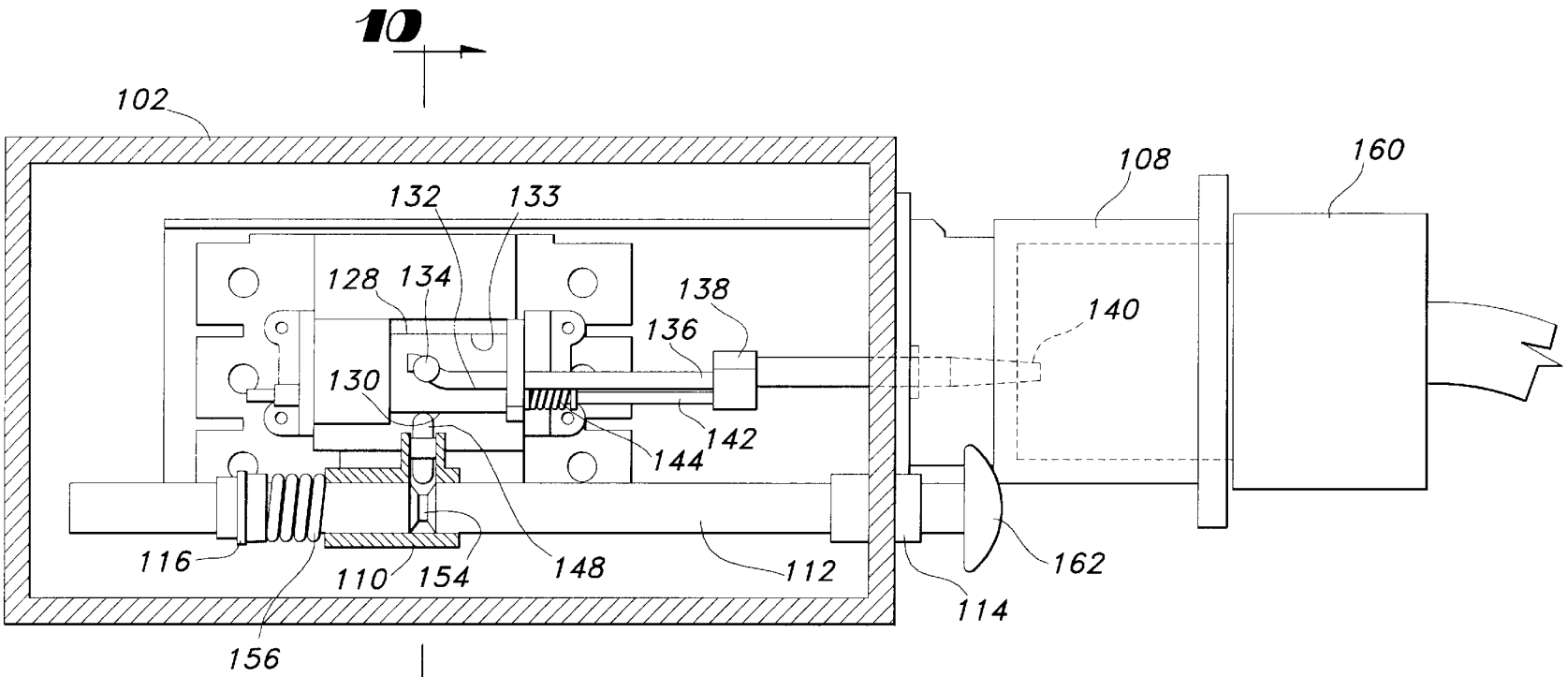
FIGS. 8 and 9 are, respectively, a top plan view and a side elevation, partially in section, of the apparatus of FIG. 1 with a plug inserted into the receptacle with the operating member moving the circuit breaker to the circuit completing "on" position.
Figure 9:
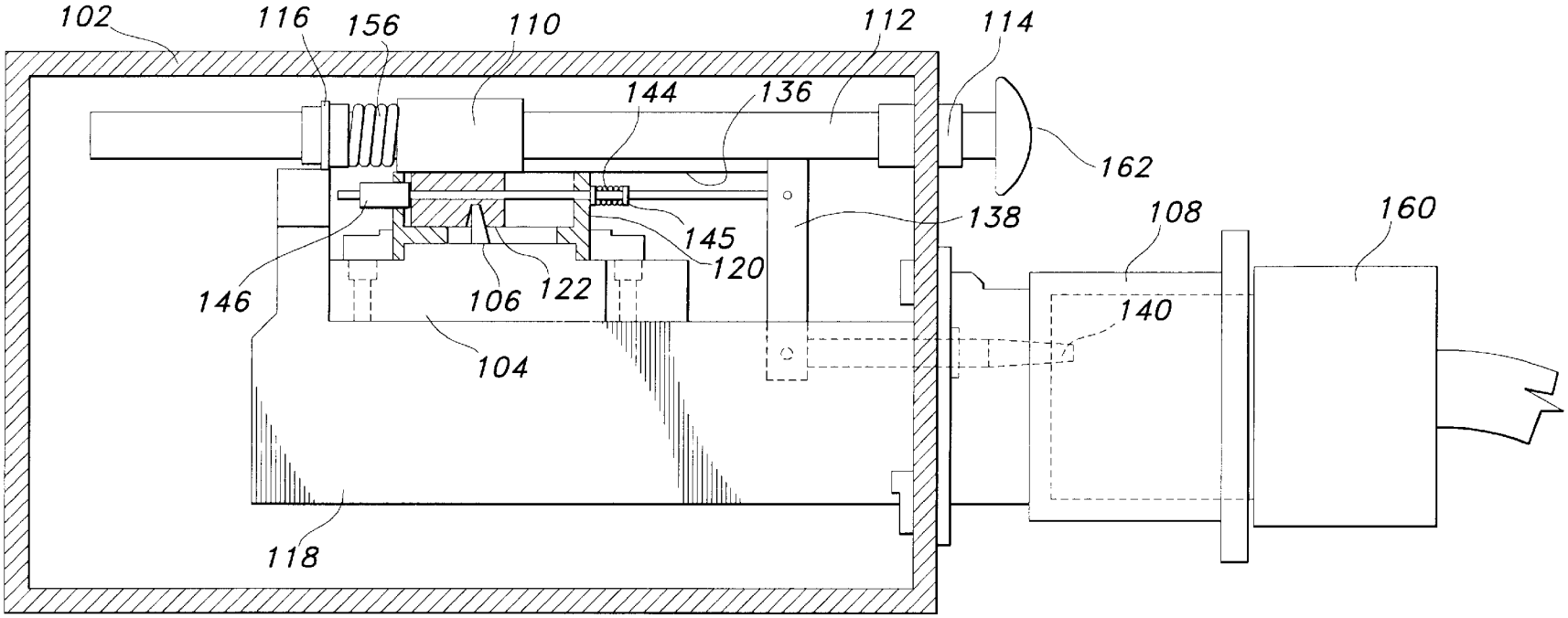
Figure 10:
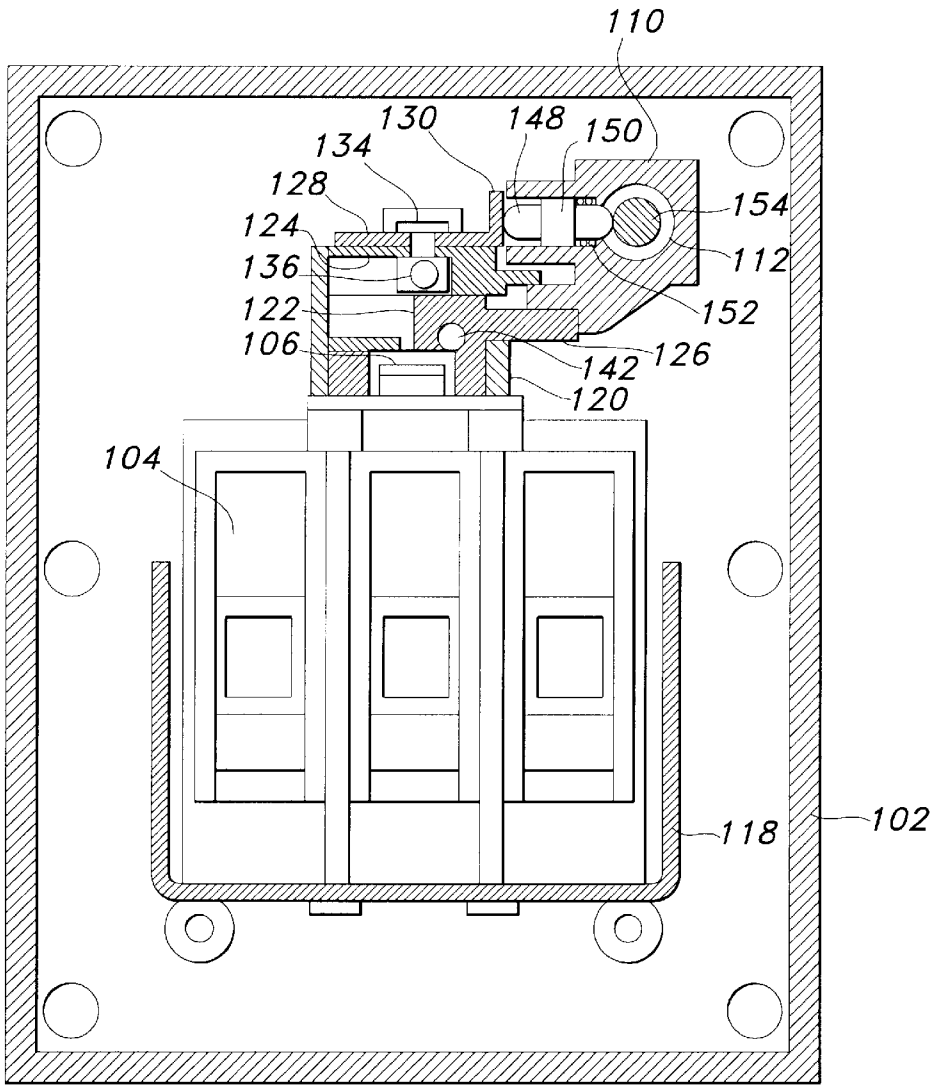
FIG. 10 is an end sectional view taken along lines 10—10 of FIG. 8.

In FIGS. 8 and 9 are illustrated the results of a human operator resetting or turning on the circuit breaker of this apparatus by pushing the handle 162 of the operating member 112 inwardly of the housing, to the left in FIGS. 8 and 9. Because the operating member 112 and the actuating member 110 are operatively connected together by their mutual engagement with the connecting member 148, the actuating member 110 and its connected toggle retainer 122 are moved to the left, thus moving the circuit breaker switch handle 106 likewise to the left, to the second, circuit completing state. The spring 156 that is compressed by movement of the actuating member 110 is selected to be sufficiently weak not to trip the circuit breaker switch handle 106 after it has been set but only to urge the actuating member 110 gently forward along the operating member 112 when there is no engagement between the operating member 112 and the actuating member 110.

If, after a plug 160 has been inserted into this apparatus and the circuit breaker 104 has been turned on, the operator desires to turn off the power without removing the plug 160, he may do so by simply pulling the handle 162 on the operating member 112 outwardly of the unit, as shown in FIGS. 6 and 7. The operative connection between the operating member 112 and the actuating member 110 effected by the engagement of those two members with the connecting member 148 will thus move the actuating member 110 and its connected toggle retainer 122 to the right in these figures, causing the toggle retainer to move the switch handle 106 back to the first, open circuit position, as shown in FIGS. 6 and 7. So long as the plug 160 remains inserted, the operator can again turn on the power by again pushing on the handle 160 to move the apparatus back to the configuration illustrated in FIGS. 8 and 9.

If the plug 160 were to be removed without first turning off the power by pulling the handle 162 outwardly of the unit, in the manner shown in FIGS. 4 and 5, the result would be exactly the same as is shown in FIGS. 1 and 2. Removal of the plug 160 would allow the spring 144 on the extension rod 142 to move that rod 142 and its connected extension rod 136 back to the right, as shown in FIGS. 1 and 2. This movement would cause the cam following pin 134 to move back along the second camming surface 133 to the position shown in FIG. 1, retracting the slide plate 128 and its actuating, portion 130 away from the actuating member 110 and permitting the resilient biasing spring 152 to urge the connecting member 148 out of engagement with the recess and operating member 112, so that the actuating member 110 may then move freely longitudinally of the operating member 112. At that same time the resilient biasing means in the form of compression spring 144 that moves the extension rod 142 to the right in FIGS. 1 and 2 will also move the retainer 146 in the same direction, thus driving the toggle retainer 122 also to the right, thereby moving the switch handle 106 back to its first position with the circuit breaker in the open circuit state. The biasing spring 156, acting against an E-clip or pin through the operating member 112 adjacent the back side of actuating member 110, will also urge the operating member 112 to the right, thus moving its handle 162 outwardly of the front of the unit. By this manner of operation the switch unit, such as the circuit breaker will always be released to the "off" position when a plug is removed, even if an operator attempts to defeat this safety feature by holding the handle 162 in while removing the plug. As described with respect to the previous embodiments, the plug or connector engaging member 140 is dimensioned such that connection between the connecting member 148 and operating member 112 and actuating member 110 cannot engage and thus connect operating member 112 and actuating member 110 unless the plug or second connector portion 160 has been sufficiently received by the receptacle or first inlet portion 108 to complete an electrical connection between the electrical connecting means carried within.

Figure 12:
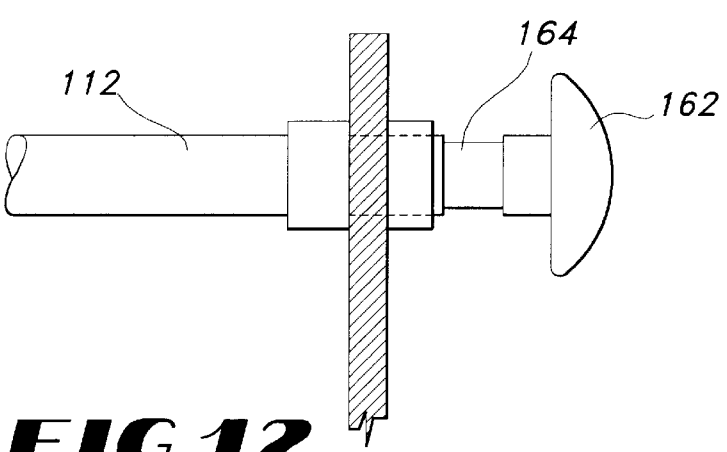
FIGS. 11 through 13 illustrate a structure for use with the operating member of this invention to indicate if the circuit breaker is on, tripped, or off.
Figure 11:
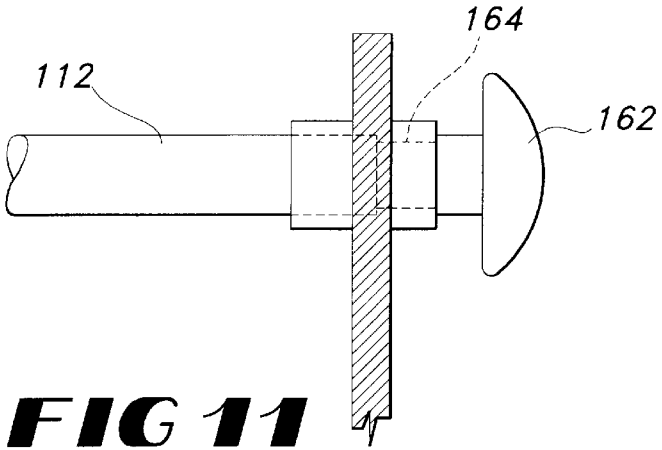
Figure 13:
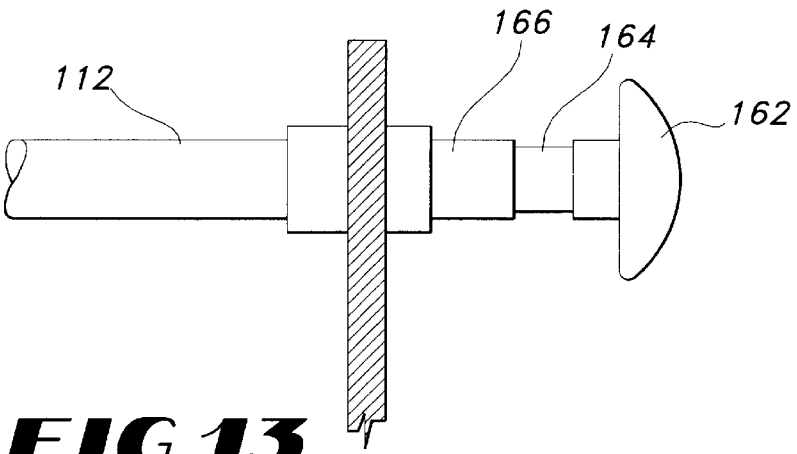
Figure 14:
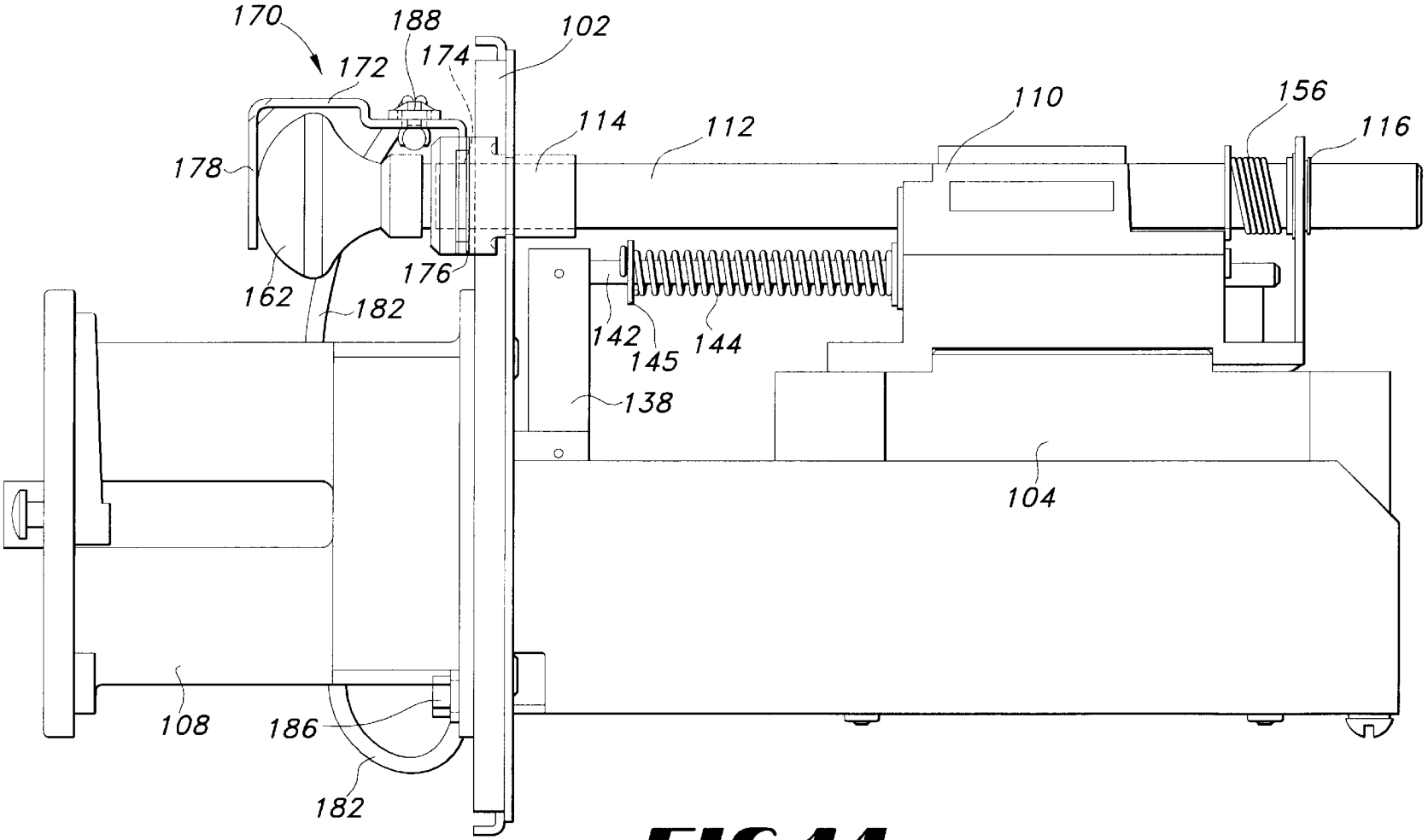
FIG. 14 is a side elevation, partially in section, of an electrical switch and interlock apparatus of the present invention including an anti-vibration retaining clip assembly.
Figure 16:
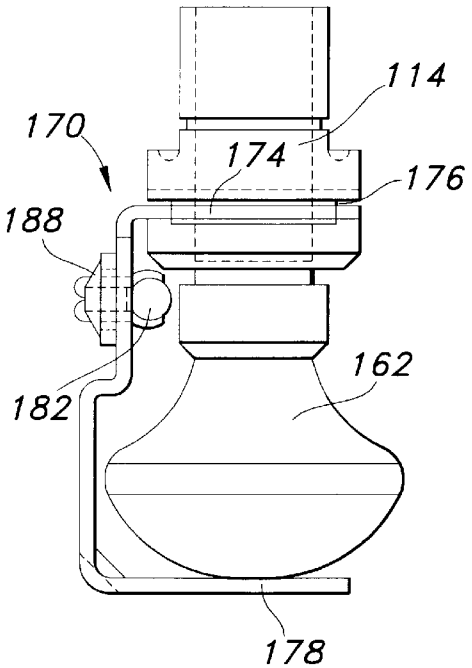
FIG. 16 is a side elevation of the anti-vibration retaining clip assembly of FIG. 14.
Figure 15:
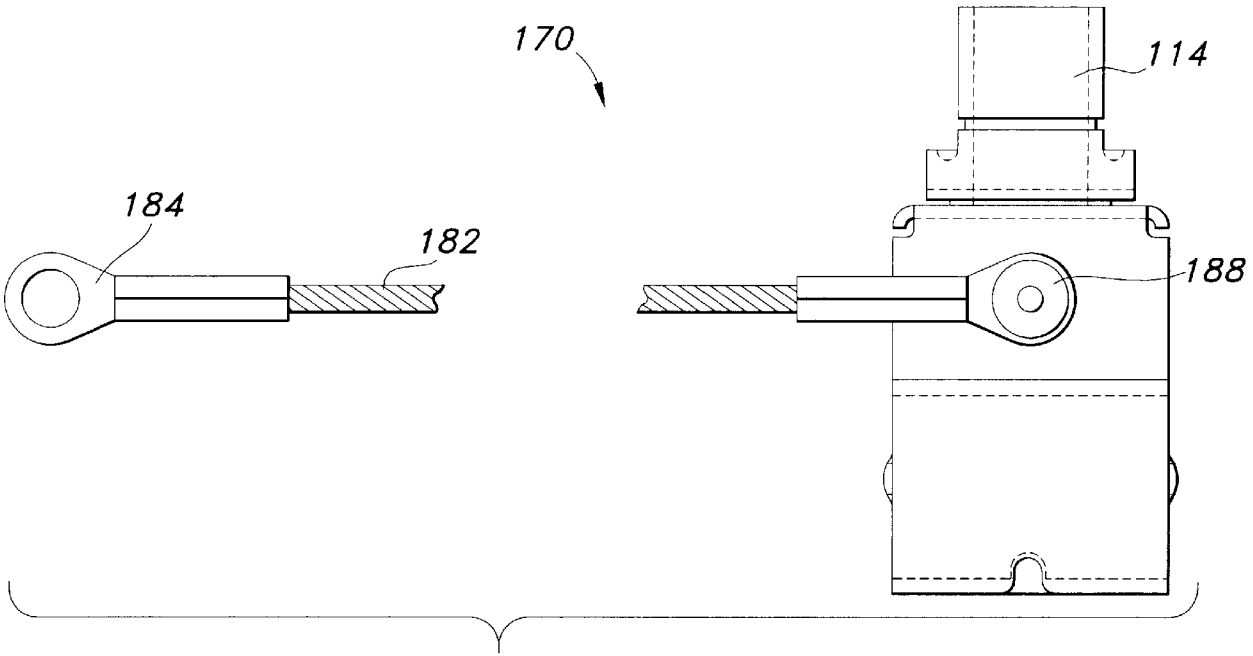
FIG. 15 is a top plan view, partially in section, of the anti-vibration retaining clip assembly of FIG. 14.
Figure 18:
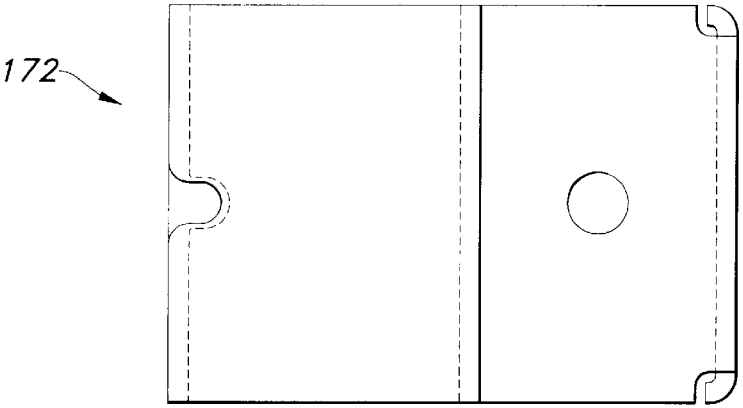
FIG. 18 is a top plan view of the retaining clip of FIG. 17.
Figure 20:
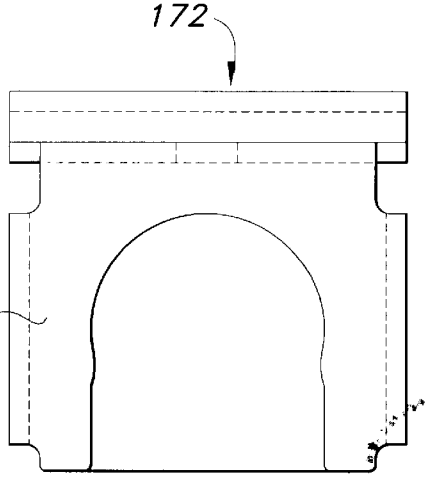
FIG. 20 is a right side elevation of the retaining clip of FIG. 17.
Figure 17:
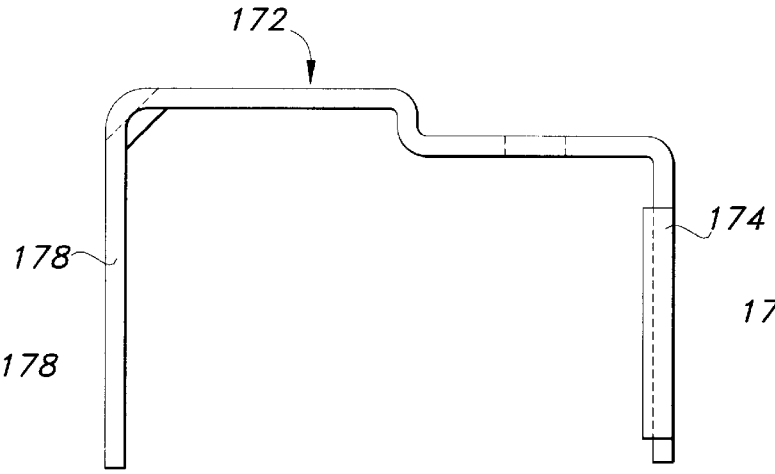
FIG. 17 is a front elevation of the retaining clip of the retaining clip assembly of FIG. 14.
Figure 19:
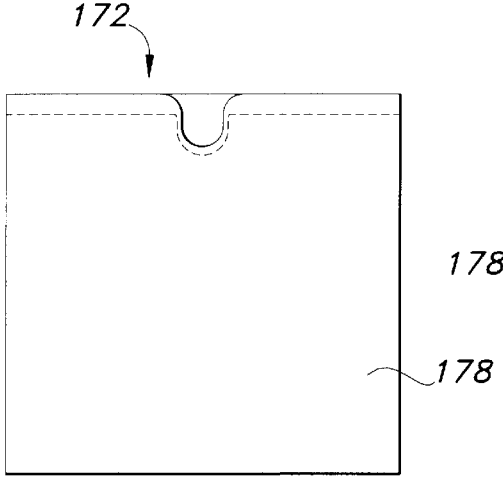
FIG. 19 is a left side elevation of the retaining clip of FIG. 17.

FIGS. 11 through 13 illustrate a convenient manner of providing an external indication of the position of the circuit breaker within its apparatus, whether the breaker be in the "on" circuit completing state, in a tripped state in which the circuit breaker has automatically disconnected its power upon sensing an overload situation, or, in the full "off" position in the open circuit state. Suitably, a band of patch 164 or visually contrasting material, such as a bright paint or the like, may be provided on the actuating member 112 at a predetermined position. This position would be such that, when a plug is inserted in the receptacle and the circuit breaker is moved to its "on" circuit completing state, the visual indication 164 would be hidden within the waterproofing bushing on the housing 102 through which the actuating member 112 extends. If the circuit breaker is tripped, but not moved to the full "off" position, that movement of the circuit breaker would urge the operating member 112 partially outwardly of the unit, to expose the visually contrasting portion immediately adjacent the waterproofing bushing through which the operating member 112 extends. When the circuit breaker has been moved to the full "off", open circuit position, either by removal of the plug from the receptacle or by an operator affirmatively moving the circuit breaker to the "off" position, that visually contrasting portion 164 on the operating member 112 would be spaced sufficiently outwardly of the bushing through which the operating member 112 extends to provide a second visually different portion 166 between that portion 164 and the bushing. Thus, by simple inspection of the appearance and position of the visually significant portion 164, an operator can readily determine the state of the circuit breaker within the unit.

Referring to FIGS. 14–20, to prevent premature tripping of the circuit breaker 104 during use in heavy vibration environments, apparatus 100 may further include a reusable clip-on anti-vibration retaining clip assembly 170 which is applied externally of housing 102 so it can be easily removed by the user regardless if the interlock mechanism i: installed in an enclosure or not. Clip assembly 170 is used to retain the operating member 112 in the second "on" position for high vibration application which, as stated above, is supported for reciprocal sliding movement by first 114 and second 116 bushings, the first 114 of which is mounted in the wall 102 of the housing 102 and extends outwardly therefrom a suitable distance. In transit applications, where vibration is a constant occurrence, such as railroad or truck transit, the clip assembly 170 prevents the operating member 112 from vibrating out and tripping the circuit breaker 104, that is, prevents the operating member 112 from moving the circuit breaker switch handle 106 via the actuating member 110 from moving back to the first, open circuit position, as explained above. The clip assembly 170 includes a clip 172 preferably formed from 16 gauge pre-galvanized steel. While the clip may be formed in any suitable shape, in a preferred embodiment, one end 174 of the clip is generally U-shaped to releasably fit into a groove 176 formed in the first bushing 114. When the clip 172 is napped into place, the opposite end 178 of the clip, which is integrally attached to end 174 by way of a central portion, extends over and engages the knob or handle 162 of the operating member 112 thereby acting as a stop for the handle 162. In the preferred embodiment, the clip is generally C-shaped. As explained above, with a plug inserted into the apparatus, the operating member 112 must be pushed into a second position in order to actuate the circuit breaker thereby compressing the compression spring 156. This results in stored energy in the spring. When vibration is introduced with an amplitude in the axial direction of the operating member 112, the operating member may work its way out with assistance from the compressed spring. The clip assembly 170 prevents the operating member 112 from vibrating out under these conditions. If desired, the clip assembly 170 may be permanently attached to the apparatus 100 by way of a cable assembly 180 to allow reusability without risk of losing the clip 172. The cable assembly 180 includes a suitable length of stainless steel cable 182, with one end 184 attached to the housing ground screw 186 and the other end 188 attached to the clip 172. It should be understood that the clip does not prevent the circuit breaker from tripping should an over-current condition exist due to the design of the interlock mechanism as explained above. Simply by removing the clip manually, one can determine if a trip condition exists by observing the operating member 112 position.

In view of the above, it will be seen that the several objects of the invention are achieved and other advantageous results attained. As various changes could be made in the above constructions without departing from the scope of the invention, it is intended that all matter contained in the above description shall be interpreted as illustrative and not in a limiting sense.

What is claimed is:

1. An electrical switch, comprising:

(a) a housing;

(b) a switch unit for selectively completing or breaking an electrical circuit, said unit being mounted within said housing and connected to a source of electrical power;

(c) a switch unit operating member being mounted to said housing for sliding movement between a first position and a second position, said operating member supported by a first bushing through said housing and a second bushing through an internal support tray, said operating member including a handle for enabling a human operator to move said operating member between said first and second positions;

(d) an actuating member mounted for movement corresponding to said movement of said operating member between said first position and said second position and being operatively connected to said switch unit for moving a portion of said switch unit between a first, open circuit state when said actuating member is in said first position and a second, circuit completing state when said actuating member is in said second position, said actuating member being resiliently biased toward said first position; and (e) a clip-on anti-vibration retaining clip assembly for maintaining said operating member in said second position, said retaining clip assembly having a generally C-shaped clip with one end releasably attached to said first bushing and an opposite end engaging said handle so as to prevent said operating member from moving to said first position, said one and opposite ends being integrally attached to one another by way of a central portion, said one end further having a generally U-shaped configuration so as to snap fit into a groove formed in said first bushing.

2. An electrical switch as defined in claim 1, wherein said anti-vibration retaining clip assembly further comprises a cable assembly for permanently attaching said clip to said housing.

* * * * *